US005729852A

United States Patent [19]

Rabideau et al.

[11] Patent Number: 5,729,852

[45] Date of Patent: Mar. 24, 1998

[54] BALLOON CUSHION MATTRESS AND TRAMPOLINE

[76] Inventors: Randall C. Rabideau, 1 Ripley Ave., PH 13, Toronto, Ontario, Canada, M6S 4Z6; Dwight J. Rabideau, RR1, Charing Cross, Ontario, Canada, N0P 1G0

[21] Appl. No.: 723,807

[22] Filed: Sep. 30, 1996

[51] Int. Cl.[6] ..... A47C 27/10

[52] U.S. Cl. ..... 5/710; 5/655.3; 482/27

[58] Field of Search ..... 5/706, 707, 710, 5/654, 655.3, 655.4, 655.5; 446/220, 221; 482/27, 29

[56] References Cited

U.S. PATENT DOCUMENTS 74,340 2/1868 Gilbert .
3,130,816 4/1964 Wright .
3,251,076 5/1966 Burke .
3,399,407 9/1968 Olsen .
3,623,566 11/1971 Orloff .
3,734,496 5/1973 Rubin .
4,516,767 5/1985 Eskijian .
4,617,690 10/1986 Grebe .
4,986,738 1/1991 Kawasaki et al. .
5,020,176 6/1991 Dotson .

*Primary Examiner*—Michael F. Trettel
*Attorney, Agent, or Firm*—Arne I. Fors

[57] ABSTRACT

A balloon filled bag for use as a mattress or children's trampoline made of a flexible membrane or textile material and stuffed with air filled elastic toy balloons that are of random size. The interstices between the larger balloons are substanially filled by the small balloons to provide additional support, comfort and to prevent injury to the user of the bag.

11 Claims, 2 Drawing Sheets

BALLOON CUSHION MATTRESS AND TRAMPOLINE

FIELD OF THE INVENTION

The present invention relates to balloon filled bags or enclosures such as cushions and mattresses, particularly for use as children's furniture, children's toys and trampolines.

BACKGROUND OF THE INVENTION

Children often amuse themselves by jumping onto and bouncing up and down on mattresses and cushioned furniture. Typically, these mattresses and padded furniture are cushioned with a combination of resilient metal springs and soft fabric stuffing such as cotton, goose down or polyester wadding. Unfortunately, injury to the children and damage to the furniture can result from repeated jumping and bouncing by children on these traditionally cushioned mattresses and furniture.

Air cushioned mattresses are known. For example, several patents teach various inflated bed systems including U.S. Pat. No. 4,617,690 to Grebe and U.S. Pat. No. 5,020,176 to Dotson. The Grebe patent teaches an elongated mattress body comprising permanently or selectively filled tube-shaped air cells or air pockets. The tubes or air pockets can be selectively inflated or deflated with a series of three-way valves and an air compressor. Similarly, U.S. Pat. No. 5,020,176 discloses another air supported bed having a series of vents and air pressure sensors to control the firmness of a series of air filled hollow cylinders. Each of these patents discloses an inflated bed system which requires a complex series of valves and compressors to inflate a fixed series of air chambers.

The use of valves, pumps, and preformed air chambers or cylinders increases the complexity and inherent cost of manufacturing these bed systems. They are unsuitable for general furniture use, particularly if exposed to the wear and tear of children's play.

Air supported trampolines are also known. U.S. Pat. No. 3,130,816 to Wright and U.S. Pat. No. 3,734,496 to Rubin describe inflated trampolines that use a toroid or donut-shaped inflated chamber to support the trampoline surface. These trampolines require specifically-made air chambers which increase their cost and increase the difficulty of assembly.

It is also known that mattress can be stuffed with elastic air-filled blocks or globules. U.S. Pat. No. 74,340 to Gilbert discloses a manner of stuffing furniture and mattresses with air-filled elastic blocks or globules that are the same size. The use of uniformly-sized elastic blocks or globules creates empty spaces between the blocks or globules. These unfilled spaces reduce the maximum number of same-sized blocks or globules which can be stuffed into a given mattress and thereby reduces the mattress's overall springiness. Further, these open spaces reduce the overall stability of the mattress as the globules or blocks adjacent to these spaces are not supported by a neighbouring block or globule. Finally, these blocks or globules would need to be specifically manufactured which increases the cost of the mattress.

SUMMARY OF THE INVENTION

It is an object of the present invention to provide a novel and inexpensive stuffing for mattresses, chairs and children's trampolines.

According to a first aspect of the present invention, a balloon filled bag comprising a flexible membrane enclosure means is adapted to define a volume of space and contains a plurality of fluid filled elastic balloons of random sizes. The fluid preferably is air or helium. The elastic balloons may be toy balloons having a pear shape, spheroid shape or sausage shape and the flexible membrane preferably is a fabric such as a nylon fabric or mesh. The bag may have a rectangular, square or circular plan shape and preferably has a resealable opening for admission of balloons.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
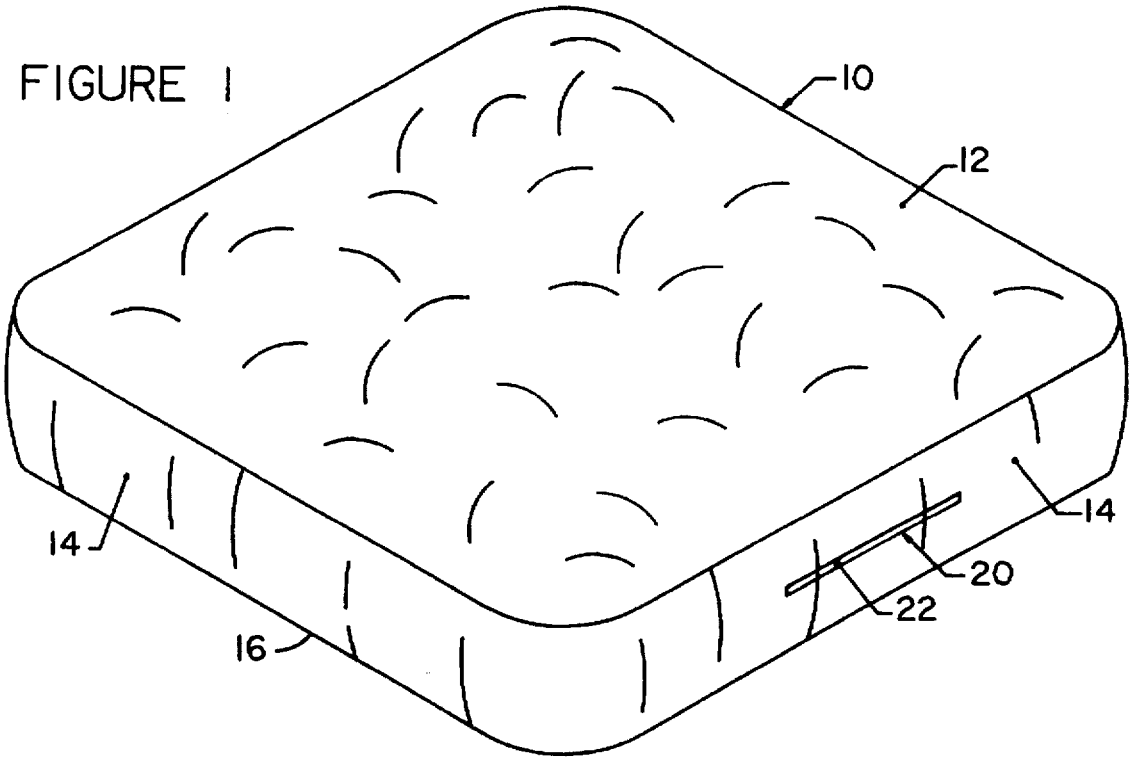
FIG. 1 shows a perspective view of a square balloon bag embodiment of the present invention.
Figure 2:
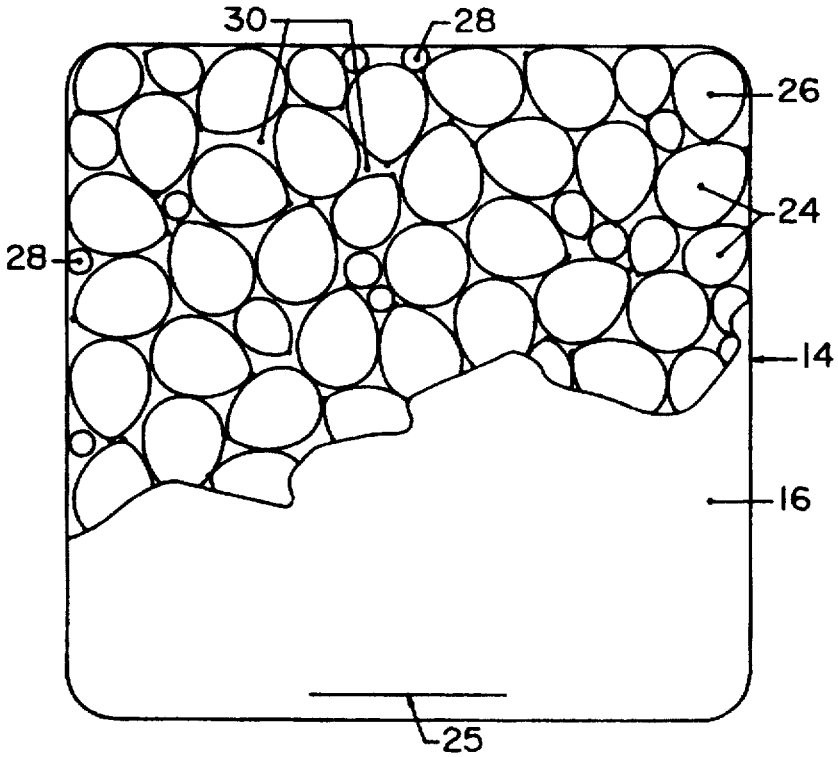
FIG. 2 shows a bottom plan view, partially cut-away of the present invention illustrated in FIG. 1, showing the toy balloon stuffing.

With reference first to FIGS. 1 and 2, a bag or the like enclosure 10 is shown having a substantially square mattress shape with a planar top wall 12, side walls 14, and planar bottom wall 16. The walls of the bag may be fabricated from a imperforate or mesh-like flexible bag material or membrane made of cotton, polyester, nylon, rayon or the like fabric or combinations thereof.

Although the description will proceed with reference to rectangular mattress shapes, it will be understood that the bag may have a rectangular shape, including square shape, L-shape for a chair, or a round shape, elliptical shape, pear shape, cylindrical shape, spheroid shape or the like shape.

An elongated slit opening 20 covered by a flap 22 containing Velcro™ patches for closure or containing a zipper, hooks, buttons, or a lace and eyelets, formed in a side wall 14 of the mattress of FIG. 1 known in the art and not shown in detail, allows the insertion of balloons 24 into the interior of bag 10.

Balloons 24 are conventional elastic balloons, such as common toy balloons, which can be inflated to a desired size, within the tensile limits of the balloon material, with air or lighter-than-air gas such as helium, and inserted within bag 10, as shown in FIG. 2, by opening slit 25. Balloons 24 are of a random size varying from large balloons 26 having a diameter of about 6–18 inches to a small size balloon 28 having a diameter of about 3 inches. The maximum size of the balloons will be determined by the thickness of the bag; eg. a bag having a thickness of six inches would have an upper limit of six inches for the maximum balloon diameter whereas a 15 inch thick bag would have an upper limit of 15 inches for the maximum balloon diameter. Balloons 24 can be substantially spherical, pear shaped, spheroid shaped or sausage shaped.

The interstices 30 between the larger balloons 26 are substantially filled by the small balloons 28 to promote an essentially balloon-filled cross-section within bag 10. It is important for the successful use of the balloon bag of the invention that the balloons have a random size with the small balloons substantially filling at least 30% of the volume in the interstices between the large balloons. This promotes continuous support to the user of the bag, such as person lying on the bag or a child jumping on the bag, thereby providing comfort or preventing injury to the more aggressive user of the balloon bag.

Figure 3:
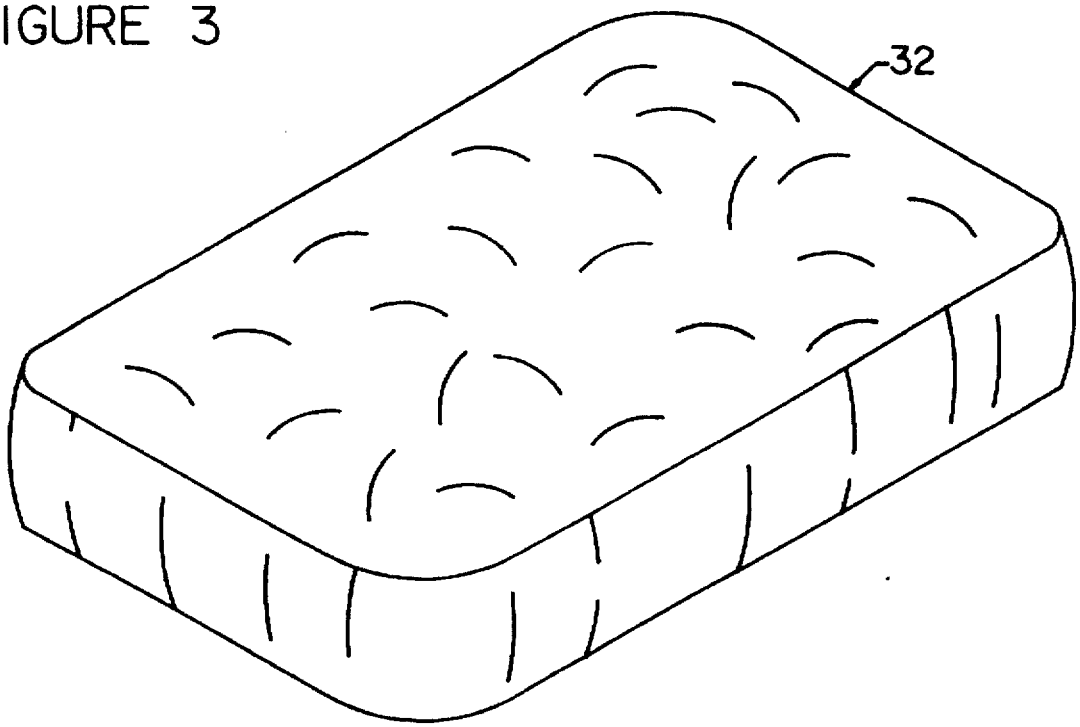
FIG. 3 shows a top perspective view of a rectangular embodiment of the present invention.
Figure 4:
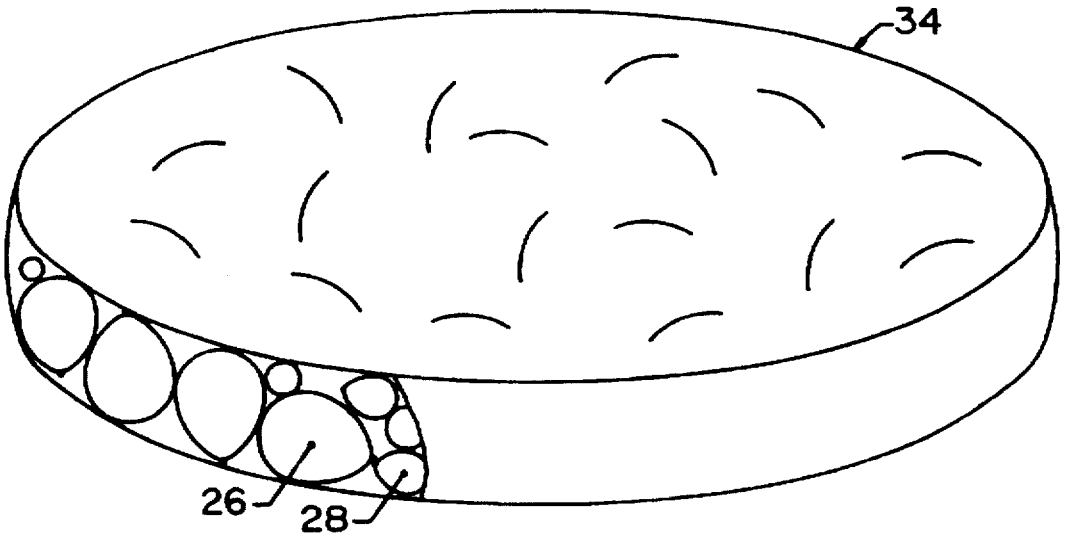
FIG. 4 shows a perspective view, partially cut-away, of a circular embodiment of the present invention.

FIG. 3 illustrates a bag 32 having an elongated rectangular mattress shape. FIG. 4 shows a bag 34 having a circular plan shape.

The rectangular embodiments of the balloon bag as shown in FIGS. 1–3 preferably range about 40–60 inches square or about 32–48 inches in width and about 50–80 inches in length, with a thickness or height of about 6–18 inches. The round embodiment shown in FIG. 4 preferably has a diameter in the range of about 40–80 inches.

The above-described embodiments of the invention are intended to be examples of the present invention and alterations and modifications maybe effected thereto, by those of skill in the art, without departing from the scope of the invention defined by the claims appended hereto.

What is claimed is:

1. A balloon filled bag comprising:

a flexible membrane enclosure memos, said enclosure means adapted to define a volume of space, a plurality of air filled elastic balloons of random sizes, contained within and filling said enclosure means, said flexible membrane enclosure means having a selectively resealable opening adapted to permit entry of said air filled balloons through said selectively reasonable opening, and the selectively reasonable opening having a hook and loop fastener, a zipper closure, buttons, or a lace and eyelets closure.

2. A balloon filled bag as defined in claim 1 wherein said flexible membrane enclosure means has a top surface, a bottom surface and a side wall surface.

3. A balloon filled bag as defined in claim 2 wherein said top and bottom surfaces of said flexible membrane enclosure means have a substantially rectangular shape.

4. A balloon filled bag as defined in claim 2 wherein said top and bottom surfaces of said flexible membrane enclosure means have a substantially square shape.

5. A balloon filled bag as defined in claim 2 wherein said top and bottom surfaces of said flexible membrane enclosure means have a substantially circular shape.

6. A balloon filled bag as defined in claim 2 wherein said air filled elastic balloons are toy balloons.

7. A balloon filled bag as defined in claim 6 wherein said toy balloons are substantially pear shaped.

8. A balloon filled bag as defined in claim 6 wherein said toy balloons are substantially spheroid shaped.

9. A balloon filled bag as defined in claim 1 wherein said flexible membrane enclosure means is a fabric.

10. A balloon filled bag as defined in claim 9 wherein said fabric is nylon fabric.

11. A balloon filled bag as defined in claim 1 wherein said flexible membrane enclosure means is a mesh.

* * * * *